US008577070B2

(12) United States Patent
Yu

(10) Patent No.: US 8,577,070 B2
(45) Date of Patent: Nov. 5, 2013

(54) SPEAKER WITH VIBRATION ABSORBING FUNCTION AND RELATED ELECTRONIC DEVICE

(75) Inventor: Ching-Jeng Yu, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 0 days.

(21) Appl. No.: 13/429,452

(22) Filed: Mar. 26, 2012

(65) Prior Publication Data

US 2013/0016865 A1 Jan. 17, 2013

(30) Foreign Application Priority Data

Jul. 12, 2011 (TW) ..... 100212767 U

(51) Int. Cl.
*H04R 25/00* (2006.01)

(52) U.S. Cl.
USPC ..... 381/353; 381/333; 381/388

(58) Field of Classification Search
USPC ..... 381/306, 87, 332, 333, 152, 353, 354, 381/386, 388, 392, 395; 181/198, 199; 361/679.23, 679.26, 679.55
See application file for complete search history.

(56) References Cited

U.S. PATENT DOCUMENTS 6,990,212 B2 * 1/2006 Kambe ..... 381/386
2008/0031485 A1 * 2/2008 Yu ..... 381/386

* cited by examiner

*Primary Examiner* — Huyen D Le
(74) *Attorney, Agent, or Firm* — Winston Hsu; Scott Margo

(57) ABSTRACT

A speaker with vibration absorbing function is disclosed in the present invention. The speaker is disposed on a boss of a casing. The speaker includes a sound box, and a supporting arm disposed on a lateral surface of the sound box. The supporting arm includes a bending portion. An end of the bending portion is connected to the sound box. The supporting arm further includes a hooking portion disposed on the other end of the bending portion for hooking the boss of the casing. Vibration generated from the sound box can decay by the bending portion, and is not transmitted to the boss via the hooking portion.

20 Claims, 6 Drawing Sheets

SPEAKER WITH VIBRATION ABSORBING FUNCTION AND RELATED ELECTRONIC DEVICE

BACKGROUND OF THE INVENTION

1. Field of the Invention

The present invention relates to a speaker and a related electronic device, and more particularly, to a speaker with vibration absorbing function and a related electronic device.

2. Description of the Prior Art

Generally, a portable consumer electronic device, such as the notebook computer or the tablet computer, includes a plurality of speaker inside the casing for preferable multimedia entertainment. The speakers are disposed on two sides of the casing, and shapes of the speaker are designed according to the casing of the electronic device, so the speakers of the consumer electronic device are light and handy. Vibration is generated from the sound box of the speaker when the speaker is broadcast, and an optical disk drive or a hard disk drive of the electronic device may be affected or damaged by the vibration. For preventing the vibration from transmitting toward the optical disk drive or the hard disk drive, a conventional method is setting a vibration-absorbing component, such as a resilient rubber, on a structural component disposed between the speaker and the casing. For example, the conventional method utilizes a screw bolt to pass through the speaker and to fix on the casing, and sheathes the resilient rubber on the screw bolt for absorbing the vibration generated from the sound box. However, the conventional vibration-absorbing method includes the plurality of resilient rubbers, and amounts of the resilient rubber corresponds to the amounts of the screw bolt, so that the conventional method has drawbacks of high manufacturing cost and large assembly hours of the electronic device.

SUMMARY OF THE INVENTION

The present invention provides a speaker with vibration absorbing function and a related electronic device for solving above drawbacks.

According to the claimed invention, a speaker includes a sound box, and a supporting arm disposed on a lateral surface of the sound box. The supporting arm includes a bending portion. An and of the bending portion is connected to the sound box, and vibration generated from the sound box decay by the bending portion. The supporting arm further includes a hooking portion disposed on the other end of the bending portion for hooking a boss of a casing. The vibration generated from the sound box decay by the bending portion and not transmitting to the boss via the hooking portion.

According to the claimed invention, the bending portion includes a first section connected to the sound box, and a second section. Two ends of the second section are respectively connected to the first section and the hooking portion, and a direction of the first section is different from a direction of the second section.

According to the claimed invention, the direction of the first section is substantially perpendicular to the direction of the second section.

According to the claimed invention, a positioning hole is formed on a surface of the hooking portion.

According to the claimed invention, the hooking portion is engaged with the boss in a tight fit manner or in a loose fit manner.

According to the claimed invention, a thickness of the supporting arm is substantially between 0.6 mm and 1.2 mm.

According to the claimed invention, the speaker further includes a sheathing component disposed on the other lateral surface of the sound box for sheathing a fixing set of the casing in a loose fit manner.

According to the claimed invention, the sheathing component is a L-shaped sheathing structure or a sheathing structure having a hole.

According to the claimed invention, the supporting arm and the sheathing component are respectively disposed on the lateral surfaces of the sound box symmetrically.

According to the claimed invention, the speaker further includes a contacting component disposed on a side of the sound box for contacting against a rib of the casing.

According to the claimed invention, an electronic device includes a casing. A boss is disposed inside the casing. The electronic device further includes a speaker disposed inside the casing. The speaker includes a sound box, and a supporting arm disposed on a lateral surface of the sound box. The supporting arm includes a bending portion. An and of the bending portion is connected to the sound box, and vibration generated from the sound box decay by the bending portion. The supporting arm further includes a hooking portion disposed on the other end of the bending portion for hooking a boss of a casing. The vibration generated from the sound box decay by the bending portion and not transmitting to the boss via the hooking portion.

According to the claimed invention, the electronic device further includes at least one vibration-absorbing component disposed on the lateral surface of the sound box adjacent to the casing.

The speaker and the related electronic device of the present invention can effectively absorb the vibration generated from the sound box, and can prevent the vibration from transmitting to the other electronic components. The speaker of the present invention does not utilize the resilient component to provide vibration absorbing function, so that the prevent invention has advantages of simple structure, easy assembly, low manufacturing cost and preferable product yield.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
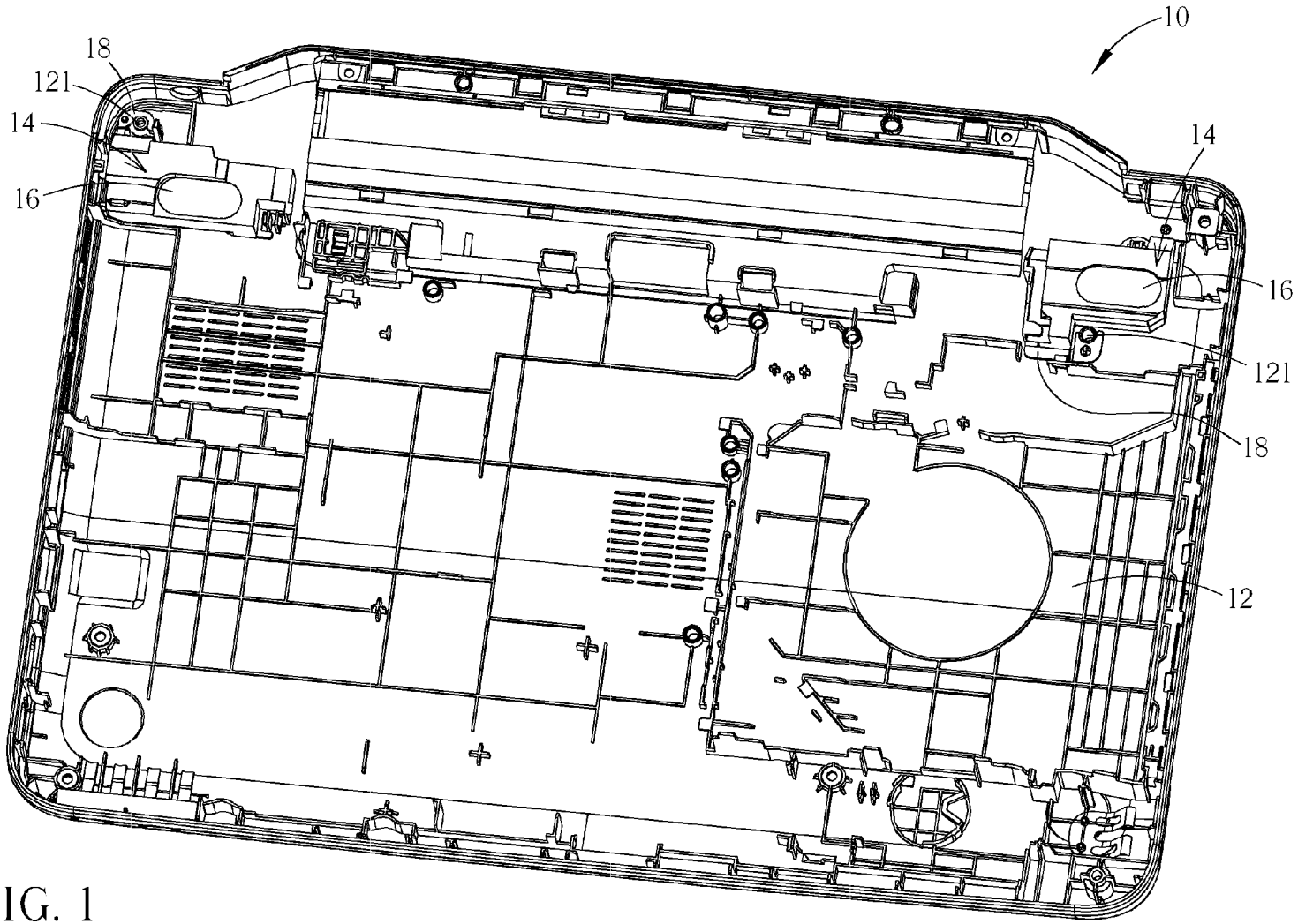
FIG. 1 is a diagram of an electronic device according to an embodiment of the present invention.

Please refer to FIG. 1. FIG. 1 is a diagram of an electronic device 10 according to an embodiment of the present invention. The electronic device 10 includes a casing 12 and two speakers 14, and the speakers 14 are respectively disposed on two sides of the casing 12, such as a right side and a left side. Generally, the electronic device 10 can be a notebook computer or a tablet computer, and the speakers 14 are disposed inside the notebook computer and respectively located at the right side and the left side of the casing 12 for multi channel entertainment. The casing 12 includes a boss 121. The speaker 14 includes a sound box 16 and a supporting arm 18. The supporting arm 18 is connected to a lateral surface of the sound box 16 and engaged with the boss 121 for fixing the sound box 16 inside the casing 12.

Figure 2:
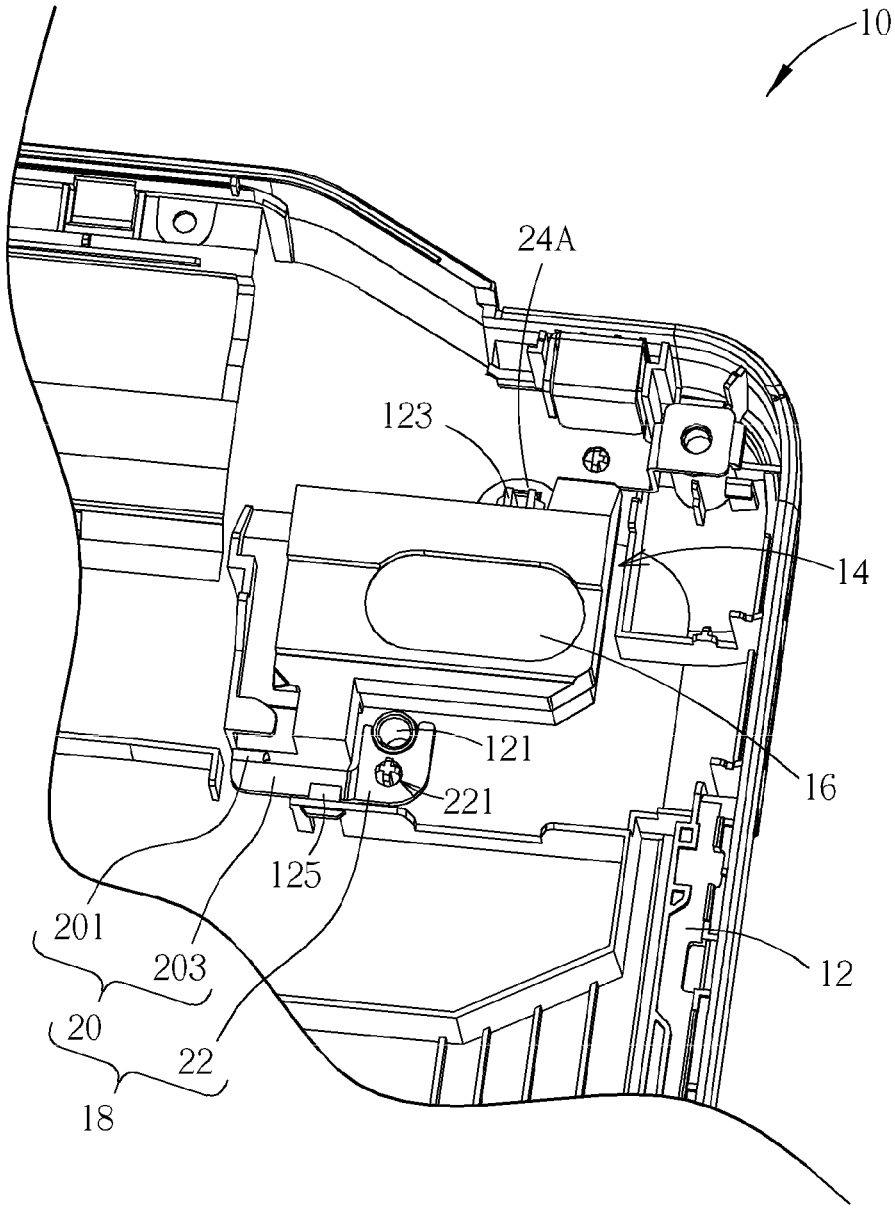
FIG. 2 and FIG. 3 are enlarged diagrams of the electronic device in different views according to the embodiment of the present invention.
Figure 3:
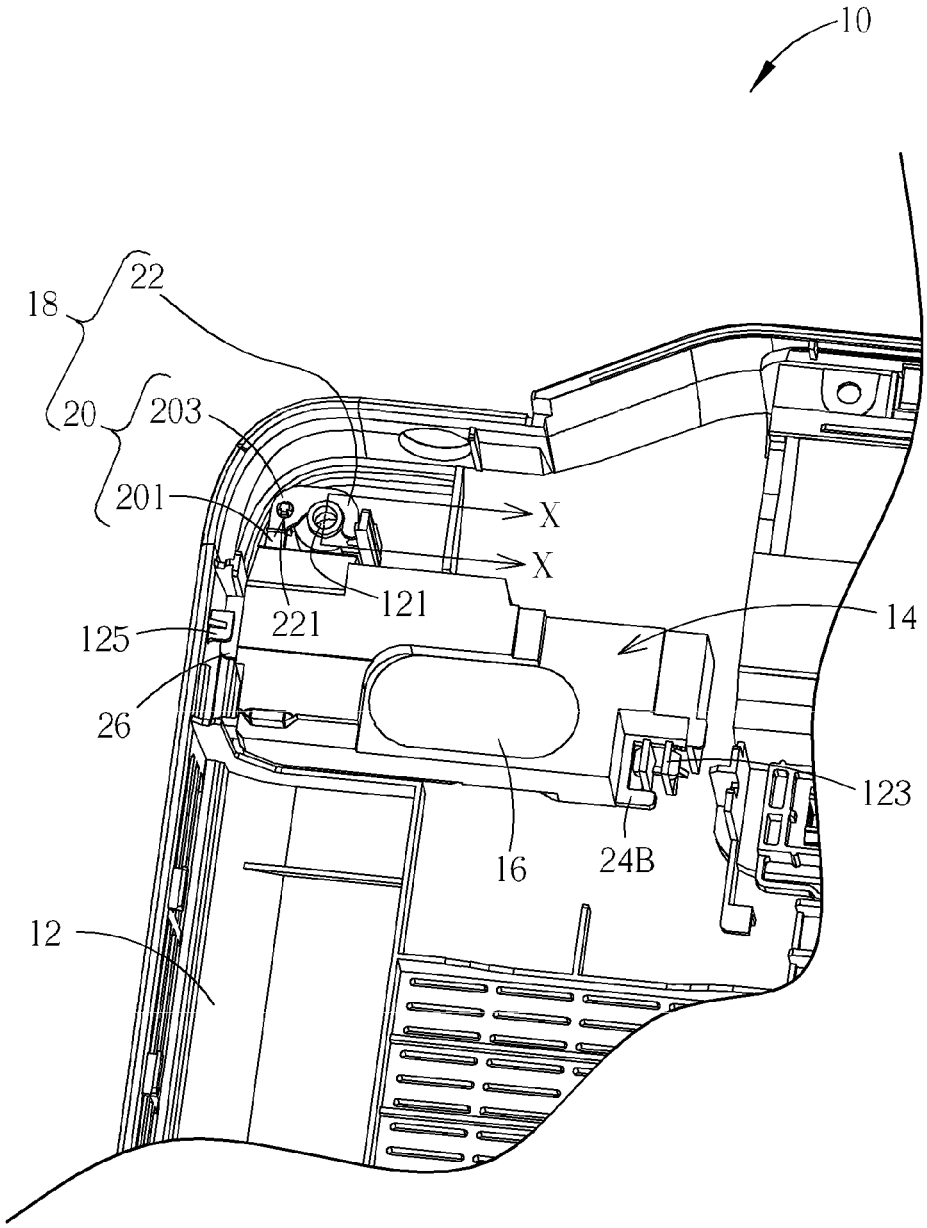
Figure 4:
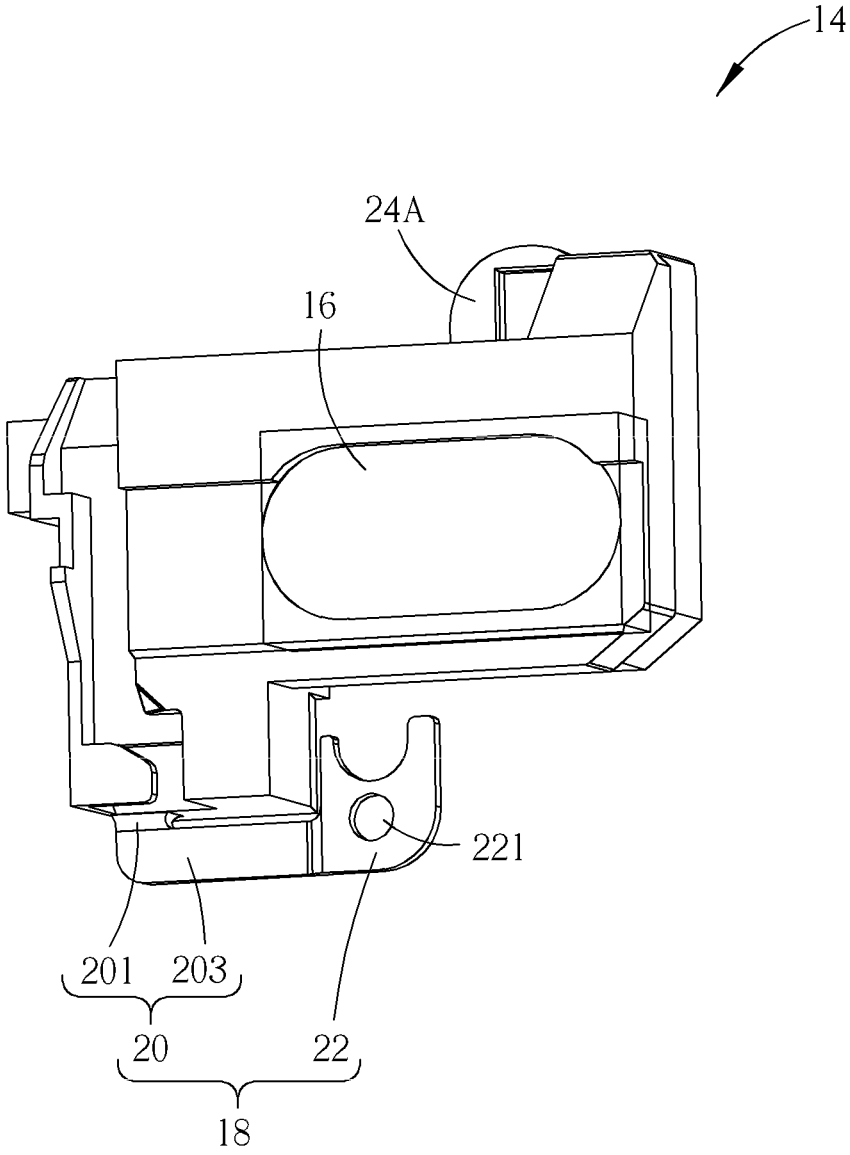
FIG. 4 and FIG. 5 are diagrams of a speaker according to different embodiments of the present invention.
Figure 5:
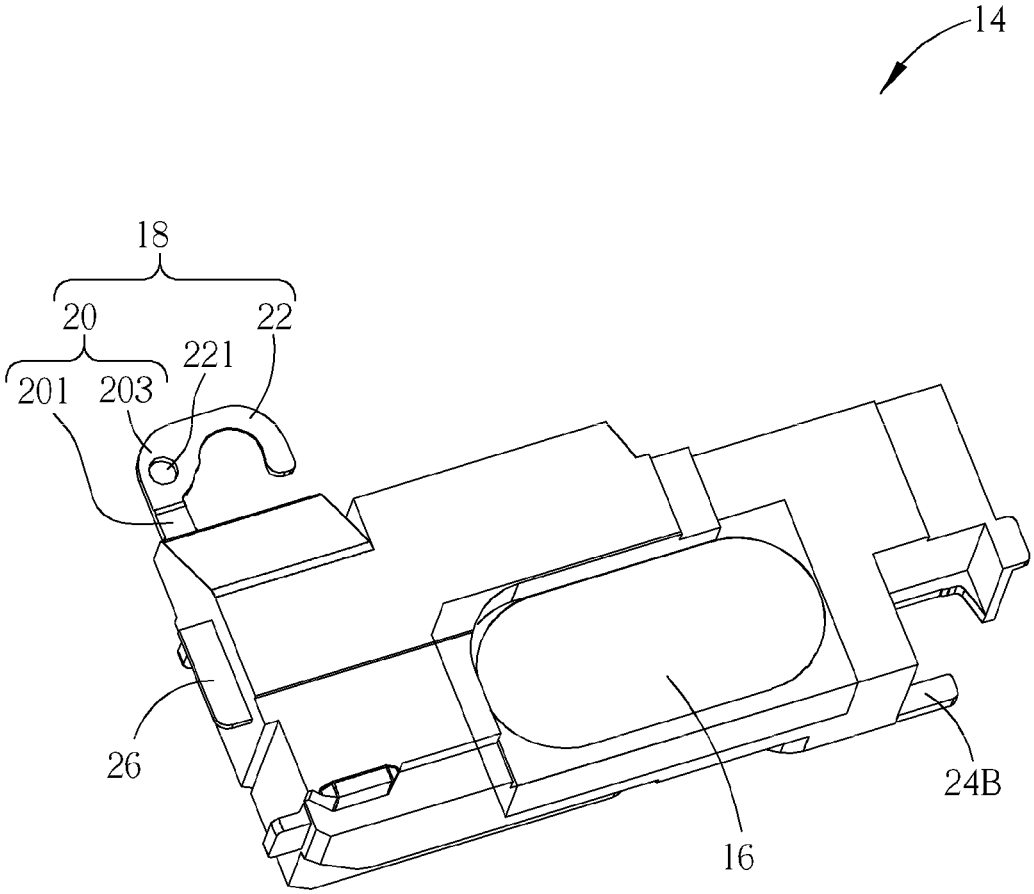

Please refer to FIG. 2 to FIG. 5. FIG. 2 and FIG. 3 are enlarged diagrams of the electronic device 10 in different views according to the embodiment of the present invention. FIG. 4 and FIG. 5 are diagrams of the speaker 14 according to different embodiments of the present invention. The supporting arm 18 of the speaker 14 includes a bending portion 20. An end of the bending portion 20 is connected to the lateral surface of the sound box 16. The supporting arm 18 further includes a hooking portion 22 disposed on the other end of the bending portion 20 for hooking the boss 121 of the casing 12. Vibration generated from the sound box 16 can decay by the bending portion 20, and does not transmit to the boss 121 via the hooking portion 22. Thus, the bending portion 20 of the speaker 14 of the present invention can absorb the vibration, the vibration generated from the sound box 16 of the speaker 14 does not transmit to the casing 12 for preventing the other electronic components of the electronic device 10 (such as the hard disk drive or the optical disk drive) from damage. For example, speed of data transmission the hard disk drive corresponds to intensity of the vibration, which means that the transmitting speed of the hard disk drive is decreased when the vibration grows.

For decaying the vibration generated from the sound box 16 by the bending portion 20 of the supporting arm 18 effectively, the bending portion 20 can include a first section 201 connected to the sound box 16, and a second section 203. Two ends of the second section 203 are respectively connected to the first section 201 and the hooking portion 22, and a direction of the first section 201 is different from a direction of the second section 203, so as to completely decay the vibration generated from the sound box 16 and to prevent the vibration from transmitting to the boss 121. In the embodiment of the present invention, the direction of the first section 201 is substantially perpendicular to the direction of the second section 203, so that the curved bending portion 20 can effectively absorb the vibration. In addition, a positioning hole 221 can be formed on a surface of the hooking portion 22. When the speaker 14 is installed inside the casing 12, a positioning pillar of the casing 12 can insert into the positioning hole 221 for correct assembly of the speaker 14.

The casing 12 can further include a fixing set 123, and the speaker 14 can further include a sheathing component 24. The sheathing component 24 can be disposed on the other lateral surface of the sound box 16 for sheathing the fixing set 123 in a loose fit manner. That is to say, assembly of the sheathing component 24 and the fixing set 123 can prevent the speaker 14 from separating from the casing 12. The sheathing component 24 can be engaged with the fixing set 123 in a slight relative sliding manner, so that the vibration generated from the sound box 16 does not transmit to the casing 12 via the sheathing component 24. As shown in FIG. 4, the sheathing component 24A can be a sheathing structure having a hole for setting on the fixing set 123 by the hole. In addition, as shown in FIG. 5, the sheathing component 24B can be a L-shaped sheathing structure for economizing structural space of the casing 12 and increasing operating convenience. The L-shaped sheathing structure can be engaged with the fixing set 123 in a relative sliding manner, so as to prevent the sound box 16 from separating from the fixing set 123 and to prevent the vibration from transmitting to the casing 12. Structure of the sheathing component 24 is designed according to the inner structural space of the casing 12 and a shape of the fixing set 123, and detailed description is omitted herein for simplicity. The supporting arm 18 and the sheathing component 24 can be respectively disposed on the different lateral surfaces of the sound box 16 symmetrically, such as diagonal corners of the sound box 16 or opposite lateral surfaces (the right surface and the left surface, or the upper surface and the low surface) of the sound box 16, so that the sound box 16 can be stably disposed inside the casing 12 by the assembly of the boss 121 and the fixing set 123.

Figure 6:
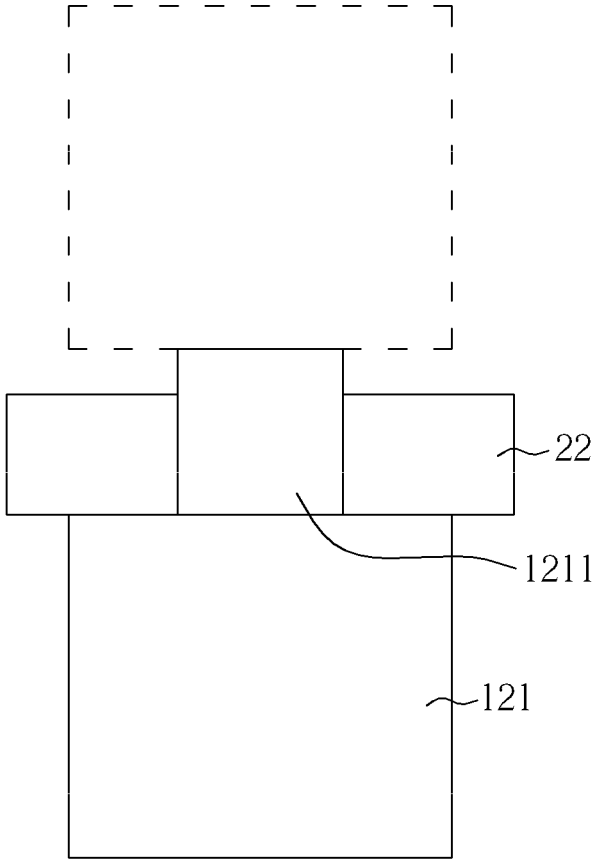
FIG. 6 is a sectional view along X-X line shown in FIG. 3.

The casing 12 can further include a rib 125. The speaker 14 can further include a contacting component 26 disposed on a side of the sound box 16, as shown in FIG. 3 and FIG. 5. The contacting component 26 can be slantwise located under the rib 125 and contact against the rib 125 tightly, and then the supporting arm 18 and the sheathing component 24 can be respectively engaged with the boss 121 and the fixing set 123 of the casing 12 for installing the speaker 14 inside the casing 12. Besides, as shown in FIG. 4 and FIG. 6, the supporting arm 18 can be for locating under the rib 125 slantwise and contacting against the rib 125, which means that the supporting arm 18 has the function the same as the contacting component 26, so that the contacting component 26 can be selectively integrated with the supporting arm 18 monolithically. Therefore, the supporting arm 18 can be for fixing the sound box 16 inside the casing 12 with the boss 121 and the rib 125. The electronic device 10 can further include at least one vibration-absorbing component (not shown in figures) disposed on the lateral surface of the sound box 16 adjacent to the casing 12. The vibration-absorbing component can be made of foam material for absorbing the vibration generated from the sound box 16 and for preventing the vibration from transmitting to the casing 12.

Disposition of the speaker 14 can be adjusted according to design demand for preferable inner structural space of the electronic device 10. For example, as shown in FIG. 2 and FIG. 4, the bending portion 20 of the speaker 14 can include the first section 201 and the second section 203 having greater dimensions. The hooking portion 22 can be tightly engaged with the boss 121, and a thickness of the supporting arm 18 (including the bending portion 20 and the hooking portion 22) can be substantially between 0.8 mm and 1.2 mm. Due to large volume of the supporting arm 18, the vibration generated from the sound box 16 can decay by the first section 201 and the second section 203, and does not transmit to the casing 12. Generally, the direction of the first section 201 can be perpendicular to the direction of the second section 203, so as to economize the structural space of the casing 12 and to stably fix the sound box 16 on the boss 121. Separately, when the casing 12 has limited inner space, as shown in FIG. 3 and FIG. 5, the bending portion 20 of the speaker 14 can include the first section 201 and the second section 203 having smaller dimensions. The hooking portion 22 can be engaged with the boss 121 in a loose fit manner, and a thickness of the supporting arm 18 (including the bending portion 20 and the hooking portion 22) can be substantially between 0.6 mm and 0.8 mm.

Please refer to FIG. 6. FIG. 6 is a sectional view along X-X line shown in FIG. 3. A length of the supporting arm 18 is short, and the vibration generated from the sound box 16 can not completely decay by the short path of the supporting arm 18 before transmitting to the boss 121. As shown in FIG. 6, the hooking portion 22 can be engaged with a loop 1211 of the boss 121, and a top of the loop 1211 can contact against an upper casing (the dotted line shown in FIG. 6). Because a thickness of the loop 1211 is substantially greater than the thickness of the hooking portion 22, the hooking portion 22 can be disposed between the boss 121 and the upper casing in a slight relative sliding manner (which means the loose fit manner). Therefore, the hooking portion 22 can repeatedly hit the loop 1211 for gradually decaying the vibration when the vibration generated from the sound box 16 transmits to the hooking portion 22, so as to effectively prevent the vibration generated from the sound box 16 from transmitting to the casing 12.

In conclusion, the present invention utilizes the rib, the sheathing component, the supporting arm and the positioning hole to stably fix the speaker inside the casing, and disposes the vibration-absorbing component, such as the foam or the rubber, between the sound box and the casing, for preventing the vibration generated from the sound box from transmitting to the casing. In addition, the sheathing component of the speaker of the present invention can be disposed on the fixing set of the casing in the loose fit manner, and the supporting arm can be engaged with the boss in the loose fit manner or in the tight fit manner alternatively. The hooking portion of the supporting arm can be tightly engaged with the boss when the supporting arm has greater dimensions, so that the vibration generated from the sound box can decay by the bending portion of the supporting arm completely. Further, the vibration generated from the sound box may partly transmit to the hooking portion via the bending portion when the supporting arm has smaller dimensions, so the hooking portion can be engaged with the boss in the loose fit manner for preventing the vibration from transmitting to the casing. Therefore, the speaker of the present invention has preferable vibration-proofing function, and can prevent operation of the electronic components, such as the hard disk drive and the optical disk drive, from damage by the vibration.

Comparing to the prior art, the speaker and the related electronic device of the present invention can effectively absorb the vibration generated from the sound box, and can prevent the vibration from transmitting to the other electronic components. The speaker of the present invention does not utilize the resilient component to provide vibration absorbing function, so that the prevent invention has advantages of simple structure, easy assembly, low manufacturing cost and preferable product yield.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A speaker, the speaker being disposed inside an electronic device, the electronic device comprising a casing, and a boss being disposed inside the casing, the speaker comprising:

a sound box; and a supporting arm disposed on a lateral surface of the sound box, the supporting arm comprising:

a bending portion, an end of the bending portion being connected to the sound box, vibration generated from the sound box decaying by the bending portion; and a hooking portion disposed on the other end of the bending portion, the hooking portion comprising a C-shaped structure for movably contacting against the boss of the casing when the sound box is actuated, the vibration generated from the sound box decaying by the bending portion and not transmitting to the boss via the hooking portion.

2. The speaker of claim 1, wherein the bending portion comprises:

a first section connected to the sound box; and a second section, two ends of the second section being respectively connected to the first section and the hooking portion, and a direction of the first section being different from a direction of the second section.

3. The speaker of claim 2, wherein the direction of the first section is substantially perpendicular to the direction of the second section.

4. The speaker of claim 1, wherein a positioning hole is formed on a surface of the hooking portion.

5. The speaker of claim 1, wherein the hooking portion is engaged with the boss in a tight fit manner or in a loose fit manner.

6. The speaker of claim 1, wherein a thickness of the supporting arm is substantially between 0.6 mm and 1.2 mm.

7. The speaker of claim 1, further comprising:

a sheathing component disposed on the other lateral surface of the sound box for sheathing a fixing set of the casing in a loose fit manner.

8. The speaker of claim 7, wherein the sheathing component is a L-shaped sheathing structure or a sheathing structure having a hole.

9. The speaker of claim 7, wherein the supporting arm and the sheathing component are respectively disposed on the lateral surfaces of the sound box symmetrically.

10. The speaker of claim 1, further comprising:

a contacting component disposed on a side of the sound box for contacting against a rib of the casing.

11. An electronic device comprising:

a casing, a boss being disposed inside the casing; and a speaker disposed inside the casing, the speaker comprising:

a sound box; and a supporting arm disposed on a lateral surface of the sound box, the supporting arm comprising:

a bending portion, an end of the bending portion being connected to the sound box, vibration generated from the sound box decaying by the bending portion; and a hooking portion disposed on the other end of the bending portion, the hooking portion comprising a C-shaped structure for movably contacting against the boss of the casing when the sound box is actuated, the vibration generated from the sound box decaying by the bending portion and not transmitting to the boss via the hooking portion.

12. The electronic device of claim 11, wherein the bending portion comprises:

a first section connected to the sound box; and a second section, two ends of the second section being respectively connected to the first section and the hooking portion, and a direction of the first section being different from a direction of the second section.

13. The electronic device of claim 12, wherein the direction of the first section is substantially perpendicular to the direction of the second section.

14. The speaker of claim 11, wherein a positioning hole is formed on a surface of the hooking portion.

15. The electronic device of claim 11, wherein the hooking portion is engaged with the boss in a tight fit manner or in a loose fit manner.

16. The electronic device of claim 11, wherein a thickness of the supporting arm is substantially between 0.6 mm and 1.2 mm.

17. The electronic device of claim 11, wherein the casing further comprises a fixing set, the speaker further comprises a sheathing component disposed on the other lateral surface of the sound box for sheathing the fixing set in a loose fit manner.

18. The electronic device of claim 17, wherein the sheathing component is a L-shaped sheathing structure or a sheathing structure having a hole.

19. The electronic device of claim 11, wherein the casing further comprises a rib, the speaker further comprises a contacting component disposed on a side of the sound box for contacting against the rib.

20. The electronic device of claim 11, wherein the electronic device further comprises at least one vibration-absorbing component disposed on the lateral surface of the sound box adjacent to the casing.

* * * * *